United States Patent [19]

Wolf

[11] Patent Number: 4,601,613

[45] Date of Patent: Jul. 22, 1986

[54] METHOD FOR MAKING A CONCRETE OR SIMILAR PILLAR ON SITE, AND RESULTING PILLAR

[75] Inventor: Chitis Wolf, Naples, Italy

[73] Assignee: Fondedile S.p.A., Italy

[21] Appl. No.: 602,078

[22] Filed: Apr. 19, 1984

[30] Foreign Application Priority Data

Apr. 19, 1983 [IT] Italy ..... 40416 A/83

[51] Int. Cl.[4] ..... E02D 5/46

[52] U.S. Cl. ..... 405/239; 405/240; 405/248

[58] Field of Search ..... 405/233, 235, 236, 239, 405/240, 241, 242, 243, 248

[56] References Cited

U.S. PATENT DOCUMENTS

| | | | |
|---|---|---|---|
| 890,765 | 6/1908 | Gilbreth | 405/242 |
| 3,504,497 | 4/1970 | Turzillo | 405/266 |
| 3,608,317 | 9/1971 | Landau | 405/248 X |
| 3,802,203 | 4/1974 | Ichise et al. | 405/264 |
| 4,397,588 | 8/1983 | Goughnour | 405/236 |

FOREIGN PATENT DOCUMENTS

| | | |
|---|---|---|
| 3033715 | 4/1982 | Fed. Rep. of Germany . |
| 2341014 | 9/1977 | France . |
| 796959 | 6/1958 | United Kingdom . |
| 1123953 | 8/1968 | United Kingdom . |
| 1518463 | 7/1978 | United Kingdom . |
| 1558694 | 1/1980 | United Kingdom . |

*Primary Examiner*—David H. Corbin

*Attorney, Agent, or Firm*—Bacon & Thomas

[57] ABSTRACT

The present invention relates to the manufacture of a concrete pillar, cast on site, in difficult grounds, not allowing the use of traditional equipment.

A rotating column equipped with nozzles at its lower end and having a reduced diameter as compared with the pillar to be built, sends, as it penetrates the ground, a powerful pressurized fluid jet; in this way a wide cavity is formed, which is filled during the same excavation with selected aggregates; finally a binding mixture is injected as the excavating tool is extracted.

5 Claims, 3 Drawing Figures

METHOD FOR MAKING A CONCRETE OR SIMILAR PILLAR ON SITE, AND RESULTING PILLAR

Concrete pillars cast on site for foundations, earth reinforcement and other underground works are largely used. The same for concrete diaphrams cast on site and obtained by a close series of pillars.

The usual procedure consists in perforating the ground with a tool having a suitable diameter, then casting the concrete or similar material. The perforation diameter must therefore be the same as the diameter of the pillar to be built.

This procedure, easy in loose ground, becomes difficult in presence of large stones or other obstructions. In these cases a jet is currently used for the excavation, followed by an injection of binding material, in order to mix with the disintegrated soil.

The jet excavation, as currently used, has however the disadvantage of creating non-uniform cavities, that is for instance a larger diameter hole in a sandy zone and a small one in clay. In addition the unit resistance of the mixed and binded material is generally of low quality, especially in clayish formation.

The present invention proposes to achieve large diameter, uniform concrete pillars in any type of ground, even into those wherein large diameter direct perforation is difficult or impossible, the quality of the final conglomerate being in the range of a normal concrete.

The procedure is based, at the start, on the disintegrating action that a pressurized fluid jet has on the ground, immediately followed by the substitution of the finer removed ground with aggregate of a proper granulometry, poured gradually into the hole during its excavation.

The loose material column thus obtained is then injected with a pressurized binding mixture. This injection can be done either through the same nozzle used for the excavating fluid jet, or through a special nozzle fed by a separate pipe.

The pressurized fluid used for the excavation can be water, water and air or also the same mixture used for binding the residual soil with aggregate.

The additional aggregates may comprise gravel and sand and also metal strips or other similar tensile resisting elements.

As a non restrictive example, I will now describe an embodiment with reference to the enclosed drawings, in which.

Figure 1:
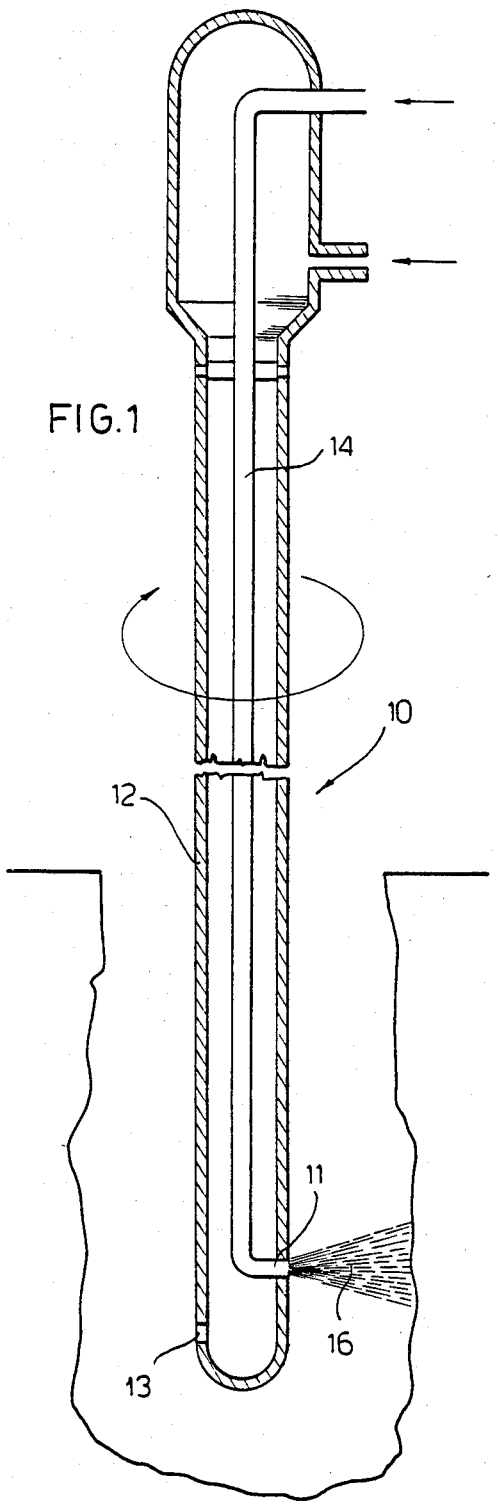
FIG. 1 is a view of a first phase.

The following phases of the procedure are listed hereunder with reference to the drawings:

(a) Perforation of the ground (FIG. 1) with a rotating tool 10 made up of a metal column having at its lower end at least one nozzle 11 through which the ground is disintegrated by a jet 16 of pressurized fluid, for example water, or water and air. The pressure of the fluid may be 300 or 400 bars or more.

The result is an excavation having a diameter remarkably bigger than the one of the tool.

The rotating tool, because of its reduced diameter can penetrate any type of ground, including that containing stones, old masonries, etc.

Figure 2:
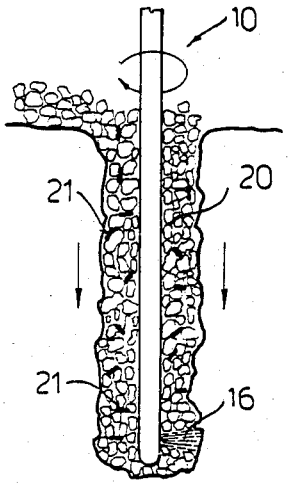
FIG. 2 is a view of a second phase.

(b) As the tool penetrates the ground, it leaves the wide cavity which is being progressively filled up, with suitable aggregate, 20 and metal strips 21 or similar resistant elements poured down from the top (FIG. 2). The presence of this material, subjected to the relevant turbulence produced by the pressure jet, increases the excavating capacity of the tool and therefore the overall diameter of the cavity.

Figure 3:
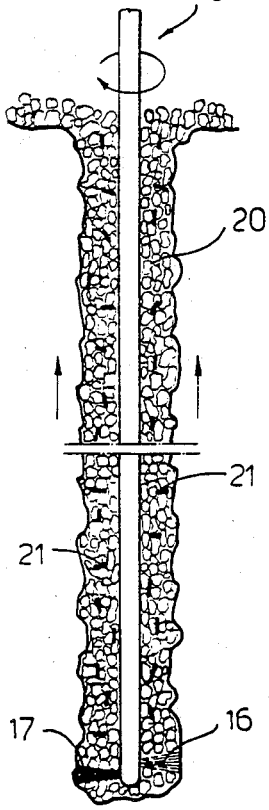
FIG. 3 is the view of the final phase.

(c) Once the desired depth has been reached, a pressurized binding mixture is sent through the perforating tool (FIG. 3) forming a jet 17. To this end, the perforating tool can be equipped with a separate pipe 12 and a nozzle 13 lower than the nozzle 11, or as an alternative, the injection may be achieved through the same pipe 14 and the same nozzle 11 already used for the inlet of water or other fluids during the perforation phase. Tool 10, still keeping its rotating motion and continuing with the binding mixture injection, and possibly also with the fluid injection is gradually lifted and recuperated, while compensating with new material a possible lowering of the level the aggregate already poured.

What I claim is:

1. A method for making a concrete pillar for foundations, ground reinforcement and other underground works comprising forming an excavation by means of a pressurized fluid sent through at least a nozzle placed at the lower end of a rotating tool having a reduced diameter as compared with that of the pillar to be built within the excavation while at the same time the excavation opening thus obtained is progressively filled from the top with aggregate for occupying the excavation opening and increasing the excavating capacity of the tool; then injecting a pressurized binding mixture in the filled excavation opening through at least another lower nozzle in the rotating tool while the rotating tool is extracted from the excavation.

2. The method according to claim 1, wherein the binding mixture is also used as a pressurized fluid for the excavation, so that the same mixture is used when the rotating tool goes down for the excavation and when the same is extracted.

3. The method according to claim 1, wherein the aggregate introduced is gravel and sand.

4. The method according to claim 1, wherein the inert material poured into the excavation contains metal strips or similar reinforcing elements.

5. The pillar built according to the method of claim 1, wherein it contains aggregate and metal strips or similar reinforcing elements.

* * * * *